US010878754B2

(12) United States Patent
Kim et al.

(10) Patent No.: US 10,878,754 B2
(45) Date of Patent: Dec. 29, 2020

(54) ORGANIC LIGHT EMITTING DISPLAY DEVICE INCLUDING A MAINTAIN TRANSISTOR

(71) Applicant: SAMSUNG DISPLAY CO, LTD., Yongin-si (KR)

(72) Inventors: Gun Hee Kim, Hwaseong-si (KR); Kyung-Bae Kim, Seongnam-si (KR); Joohee Jeon, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/359,366

(22) Filed: Mar. 20, 2019

(65) Prior Publication Data

US 2019/0295470 A1 Sep. 26, 2019

(30) Foreign Application Priority Data

Mar. 21, 2018 (KR) ..... 10-2018-0032571

(51) Int. Cl.
*G09G 3/3258* (2016.01)

(52) U.S. Cl.
CPC ... *G09G 3/3258* (2013.01); *G09G 2300/0866* (2013.01); *G09G 2310/06* (2013.01); *G09G 2320/043* (2013.01)

(58) Field of Classification Search
CPC ..... G09G 3/3258
See application file for complete search history.

(56) References Cited

U.S. PATENT DOCUMENTS

| | | | | |
|---|---|---|---|---|
| 9,591,715 | B2 | 3/2017 | Gai et al. | |
| 2006/0007204 | A1 | 1/2006 | Reddy et al. | |
| 2014/0139502 | A1* | 5/2014 | Han | G09G 3/3233 345/212 |
| 2014/0353608 | A1* | 12/2014 | Kim | G09G 3/3233 257/40 |
| 2015/0200239 | A1* | 7/2015 | Jung | H01L 27/3265 257/40 |
| 2016/0043159 | A1* | 2/2016 | Kim | H01L 27/3265 257/71 |
| 2016/0103513 | A1* | 4/2016 | Yang | G09G 3/3258 345/175 |
| 2016/0125798 | A1* | 5/2016 | Park | G09G 3/3208 345/690 |

(Continued)

FOREIGN PATENT DOCUMENTS

| | | |
|---|---|---|
| KR | 1020060117690 | 11/2006 |
| KR | 10-0795810 | 1/2008 |

(Continued)

*Primary Examiner* — William Boddie
*Assistant Examiner* — Andrew B Schnirel
(74) *Attorney, Agent, or Firm* — F. Chau & Associates, LLC

(57) ABSTRACT

An organic light emitting display device includes a display panel including a plurality of pixels and a panel driver configured to generate driving signals to drive the plurality of pixels. Each of the plurality of pixels includes a first transistor, a second transistor, a storage capacitor, a third transistor, a maintain capacitor, a fourth transistor, a fifth transistor, and an organic light emitting diode. The maintain capacitor is configured to maintain a gate voltage of the first transistor during an emission period of the pixels.

5 Claims, 15 Drawing Sheets

(56) References Cited

U.S. PATENT DOCUMENTS

| | | | | |
|---|---|---|---|---|
| 2016/0322450 | A1* | 11/2016 | Lee | H01L 27/3265 |
| 2017/0076671 | A1* | 3/2017 | Kim | G09G 3/3266 |
| 2017/0124941 | A1 | 5/2017 | Na et al. | |
| 2017/0365214 | A1* | 12/2017 | Tsai | G09G 3/3233 |

FOREIGN PATENT DOCUMENTS

| | | |
|---|---|---|
| KR | 1020160032755 | 3/2016 |
| KR | 10-1676223 | 11/2016 |
| KR | 1020160129157 | 11/2016 |
| KR | 1020170081082 | 7/2017 |

* cited by examiner

ORGANIC LIGHT EMITTING DISPLAY DEVICE INCLUDING A MAINTAIN TRANSISTOR

CROSS-REFERENCE TO RELATED APPLICATION

This application claims priority under 35 U.S.C. § 119 to Korean Patent Application No. 10-2018-0032571, filed on Mar. 21, 2018 in the Korean Intellectual Property Office (KIPO), the disclosure of which is incorporated by reference herein in its entirety.

TECHNICAL FIELD

Exemplary embodiments of the inventive concept relate generally to an organic light emitting display device.

DISCUSSION OF RELATED ART

Flat panel display (FPD) devices are widely used as display devices of electronic devices because FPD devices are relatively lightweight and thin compared to cathode-ray tube (CRT) display devices. Examples of FPD devices include liquid crystal display (LCD) devices, field emission display (FED) devices, plasma display panel (PDP) devices, and organic light emitting display (OLED) devices. OLED devices have been spotlighted as next-generation display devices because they have various advantages such as a wide viewing angle, a rapid response speed, low thickness, low power consumption, etc.

A pixel of the OLED device may include a driving transistor that generates a driving current. The pixel may further include additional components for compensating for a threshold voltage of the driving transistor and initializing an anode of an organic light emitting diode to improve display defects such as luminance deviation.

The transistors included in the pixel may be degraded by a voltage flowing through the lines in the organic light emitting display panel as a usage time of the OLED device passes. When the threshold voltage of the transistor is changed because of the degradation of the transistor, luminance of an image displayed on a display panel may decrease.

SUMMARY

According to an exemplary embodiment of the inventive concept, an organic light emitting display device may include a display panel including a plurality of pixels, a plurality of scan lines, a plurality of data lines, a first power voltage providing line, a second power voltage providing line, and a plurality of emission control lines, and a panel driver configured to provide a scan signal, a data voltage, a first power voltage, a second power voltage, and an emission control signal to drive the plurality of pixels. Each of the plurality of pixels may include a first transistor including a first electrode coupled to a first node, a second electrode coupled to a second node, and a gate electrode coupled to a third node, a second transistor including a gate electrode configured to receive the scan signal, a first electrode configured to receive the data voltage, and a second electrode coupled to the first node, a storage capacitor including a first electrode configured to receive the first power voltage and a second electrode coupled to the third node, a third transistor including a gate electrode configured to receive the scan signal, a first electrode coupled to the third node, and a second electrode coupled to the second node, a maintain capacitor coupled to the third node, where the maintain capacitor is configured to maintain a gate voltage of the first transistor during an emission period of a corresponding pixel, a fourth transistor including a gate electrode configured to receive the emission control signal, a first electrode coupled to the first power voltage providing line, and a second electrode coupled to the first node, a fifth transistor including a gate electrode configured to receive the emission control signal, a first electrode coupled to the second node, and a second electrode coupled to a fourth node, and an organic light emitting diode including a first electrode coupled to the fourth node and a second electrode configured to receive the second power voltage.

In an exemplary embodiment of the inventive concept, the maintain capacitor may include a first electrode that receives the data voltage and a second electrode coupled to the third node.

In an exemplary embodiment of the inventive concept, each of the plurality of pixels may further include a maintain transistor including a gate electrode configured to receive the emission control signal, a first electrode coupled to the second electrode of the maintain capacitor, and a second electrode coupled to the third node.

In an exemplary embodiment of the inventive concept, the maintain transistor may turn on in response to the emission control signal during the emission period of the corresponding pixel.

In an exemplary embodiment of the inventive concept, the maintain capacitor may include a first electrode configured to receive a third power voltage and a second electrode coupled to the third node.

In an exemplary embodiment of the inventive concept, the third power voltage may be a constant voltage having a predetermined voltage level.

In an exemplary embodiment of the inventive concept, the maintain capacitor may include a first electrode coupled to the first node and a second electrode coupled to the third node.

In an exemplary embodiment of the inventive concept, the display panel may further include an initialization control line, an initialization voltage providing line, and a bypass line, and the panel driver may provide an initialization control signal and a bypass signal to drive the plurality of pixels.

In an exemplary embodiment of the inventive concept, each of the plurality of pixels further may include a sixth transistor including a gate electrode configured to receive the initialization control signal, a first electrode coupled to the third node, and a second electrode coupled to a fifth node, and a seventh transistor including a gate electrode configured to receive the bypass signal, a first electrode coupled to the fifth node, and a second electrode coupled to the fourth node.

In an exemplary embodiment of the inventive concept, one frame cycle may include a first initialization period that initializes the gate electrode of the first transistor, a second initialization period that initializes the first electrode of the organic light emitting diode, a writing period in which the data voltage is stored in the storage capacitor, and the emission period in which the organic light emitting diode emits light.

According to an exemplary embodiment of the inventive concept, an organic light emitting display device may include a display panel including a plurality of pixels, a plurality of scan lines, a plurality of data lines, a first power voltage providing line, a second power voltage providing line, a plurality of emission control lines, and a plurality of scan control lines coupled to the plurality of pixels, and a panel driver configured to provide a scan signal, a data voltage, a first power voltage, a second power voltage, an emission control signal, and a scan control signal to drive the plurality of pixels. Each of the plurality of pixels may include a first transistor including a first electrode coupled to a first node, a second electrode coupled to a second node, and a gate electrode coupled to a third node, a second transistor including a gate electrode coupled to a fourth node, a first electrode configured to receive the data voltage, and a second electrode coupled to the first node, a storage capacitor including a first electrode configured to receive the first power voltage and a second electrode coupled to the third node, a third transistor including a gate electrode coupled to the fourth node, a first electrode coupled to a fifth node, and a second electrode coupled to the second node, a fourth transistor including a gate electrode configured to receive the emission control signal, a first electrode coupled to the first power voltage providing line, and a second electrode coupled to the first node, a fifth transistor including a gate electrode configured to receive the emission control signal, a first electrode coupled to the second node, and a second electrode coupled to a sixth node, and an organic light emitting diode including a first electrode coupled to the sixth node and a second electrode configured to receive the second power voltage. Each of the plurality of pixels arranged in a first column of the plurality of pixels may include a first scan control transistor including a gate electrode configured to receive the scan control signal, a first electrode coupled to the scan line, and a second electrode coupled to the fourth node, and a second scan control transistor including a gate electrode configured to receive the scan control signal, a first electrode coupled to the third node, and a second electrode coupled to the fifth node.

In an exemplary embodiment of the inventive concept, the first scan control transistor may block the scan signal provided to the gate electrode of the third transistor in response to the scan control signal during an emission period of a corresponding pixel.

In an exemplary embodiment of the inventive concept, the second scan control transistor may block a connection between the storage capacitor and the first electrode of the third transistor in response to the scan control signal during an emission period of a corresponding pixel.

In an exemplary embodiment of the inventive concept, the scan control signal may be an inversion signal of the emission control signal.

In an exemplary embodiment of the inventive concept, the display panel further may include an initialization control line, an initialization voltage providing line, and a bypass line. The panel driver may provide an initialization control signal and a bypass signal to drive the plurality of pixels.

In an exemplary embodiment of the inventive concept, each of the plurality of pixels may include a sixth transistor including a gate electrode configured to receive the initialization control signal, a first electrode coupled to the fifth node, and a second electrode coupled to a seventh node, and a seventh transistor including a gate electrode configured to receive the bypass signal, a first electrode coupled to the seventh node, and a second electrode coupled to the sixth node.

In an exemplary embodiment of the inventive concept, one frame period may include a first initialization period that initializes the gate electrode of the first transistor, a second initialization period that initializes the first electrode of the organic light emitting diode, a writing period during which the data voltage is stored in the storage capacitor, and an emission period during which the organic light emitting diode emits light.

In an exemplary embodiment of the inventive concept, the first scan control transistor may provide the scan signal to the second transistor and the third transistor by turning on in the initialization period, the second initialization period, and the writing period.

In an exemplary embodiment of the inventive concept, the second scan control transistor may couple the gate electrode of the first transistor and the first electrode of the third transistor by turning on in the first initialization period, the second initialization period, and the writing period.

In an exemplary embodiment of the inventive concept, the first scan control transistor and the second scan control transistor may turn on in the emission period.

According to an exemplary embodiment of the inventive concept, a pixel of an organic light emitting display device may include a first transistor including a first electrode coupled to a first node, a second electrode coupled to a second node, and a gate electrode coupled to a third node, a second transistor including a gate electrode configured to receive a scan signal, a first electrode configured to receive a data voltage, and a second electrode coupled to the first node, a storage capacitor including a first electrode configured to receive a first power voltage and a second electrode coupled to the third node, a third transistor including a gate electrode configured to receive the scan signal, a first electrode coupled to the third node, and a second electrode coupled to the second node, a maintain capacitor coupled to the third node, wherein the maintain capacitor is configured to maintain a gate voltage of the first transistor during an emission period of the pixel, a fourth transistor including a gate electrode configured to receive a emission control signal, a first electrode coupled to the first power voltage providing line, and a second electrode coupled to the first node, a fifth transistor including a gate electrode configured to receive the emission control signal, a first electrode coupled to the second node, and a second electrode coupled to a fourth node, and an organic light emitting diode including a first electrode coupled to the fourth node and a second electrode configured to receive a second power voltage.

BRIEF DESCRIPTION OF THE DRAWINGS

The above and other features of the inventive concept will be more clearly understood by describing in detail exemplary embodiments thereof with reference to the accompanying drawings.

DETAILED DESCRIPTION OF THE EMBODIMENTS

Figure 1:
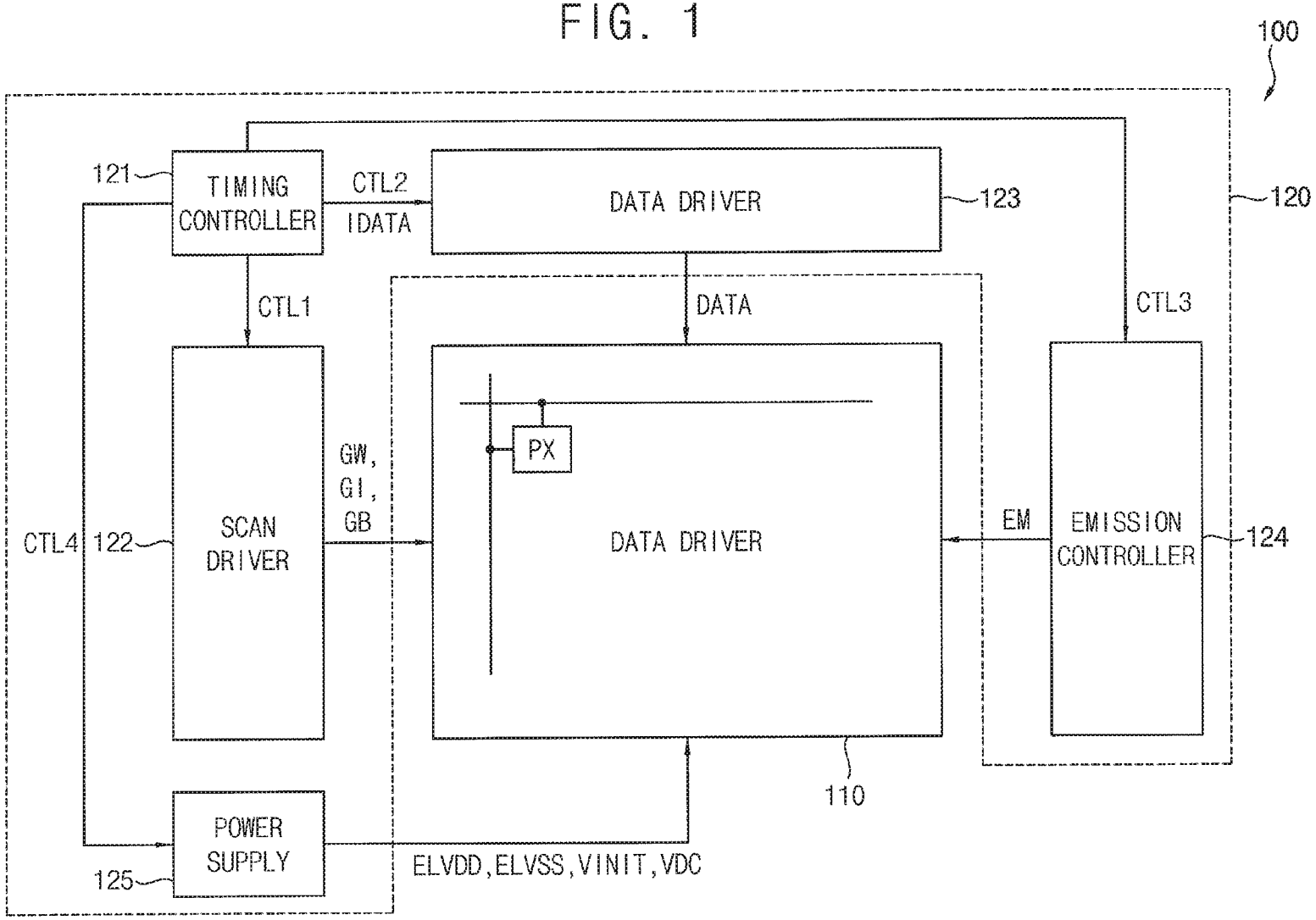
FIG. 1 is a block diagram illustrating an organic light emitting display device according to an exemplary embodiment of the inventive concept.

Exemplary embodiments of the inventive concept provide an organic light emitting display device capable of improving display quality by maintaining a gate voltage of a gate electrode of a driving transistor during an emission period.

Exemplary embodiments of the inventive concept also provide an organic light emitting display device capable of improving display quality by blocking a scan signal provided to a pixel during an emission period.

Hereinafter, exemplary embodiments of the inventive concept will be explained in detail with reference to the accompanying drawings Like reference numerals may refer to like elements throughout this application.

Figure 2:
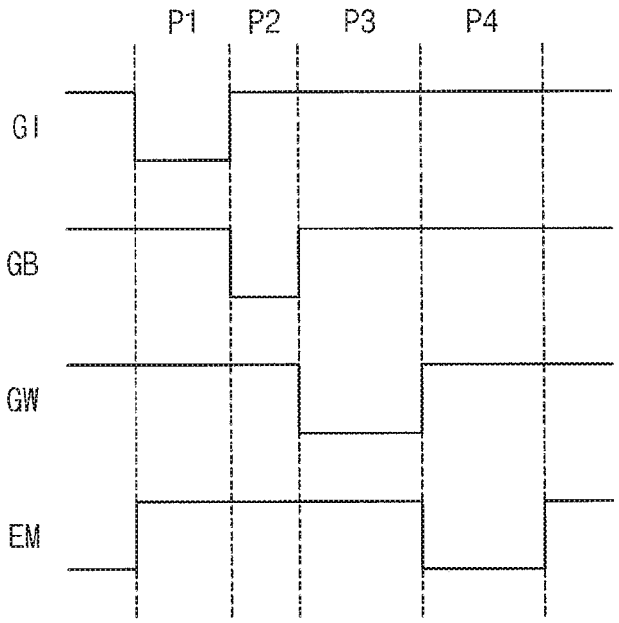
FIG. 2 is a timing diagram illustrating a driving timing of a pixel included in the organic light emitting display device of FIG. 1 according to an exemplary embodiment of the inventive concept.

FIG. 1 is a block diagram illustrating an organic light emitting display device according to an exemplary embodiment of the inventive concept and FIG. 2 is a timing diagram illustrating a driving timing of a pixel included in the organic light emitting display device of FIG. 1 according to an exemplary embodiment of the inventive concept.

Referring to FIG. 1, an organic light emitting display device 100 may include a display panel 110 and a panel driver 120.

The display panel 110 may include a plurality of pixels PX. The display panel 110 may include a plurality of scan lines, a plurality of data lines, a first power voltage providing line, a second power voltage providing line, and a plurality of emission control lines coupled to the pixels PX. The display panel 110 may further include an initialization control line, an initialization voltage providing line, and a bypass line.

Each of the pixels PX may include a first transistor, a second transistor, a storage capacitor, a third transistor, a maintain capacitor, an organic light emitting diode, a fourth transistor, and a fifth transistor. Each of the pixels PX may further include a sixth transistor and a seventh transistor.

The first transistor may generate a driving current in response to a data voltage DATA (e.g., the first transistor may be a driving transistor.) The second transistor may transfer the data voltage DATA provided through the data line in response to a scan signal GW provided through the scan line. The storage capacitor may be coupled between the first power voltage providing line and a gate electrode of the first transistor, and store the data voltage DATA. The third transistor may compensate a threshold voltage of the first transistor in response to the scan signal GW. The maintain capacitor may be coupled to the gate electrode of the first transistor and maintain a gate voltage of the first transistor during an emission period P4 of the pixel PX. The organic light emitting diode may emit light based on the driving current during the emission period P4. The fourth transistor and the fifth transistor may provide the driving current to the organic light emitting diode in response to an emission control signal EM provided through the emission control line. The sixth transistor may transfer an initialization voltage VINIT provided through the initialization providing line in response to an initialization control signal GI provided through the initialization control line. The seventh transistor may transfer the initialization voltage VINIT provided through the initialization voltage providing line to an anode electrode of the organic light emitting diode in response to a bypass signal GB provided through the bypass line.

Referring to FIG. 2, one frame cycle may include a first initialization period P1, a second initialization period P2, a writing period P3, and the emission period P4. The organic light emitting display device 100 may be operated in the first initialization period P1 that initializes the gate electrode of the first transistor, the second initialization period P2 that initializes the anode electrode of the organic light emitting diode, the writing period P3 during which the data voltage DATA is stored in the storage capacitor, and the emission period P4 during which the organic light emitting diode emits light.

In the emission period P4 of the organic light emitting display device 100, the third transistor may turn off, and the fourth and fifth transistors may turn on. In the emission period P4 of the organic light emitting display device 100, the scan signal GW having a turn-off level may be provided to the third transistor, and the emission control signal EM having a turn-on level may be provided to the fourth and fifth transistors. Here, the turn-off level is a voltage level that turns off the third transistor. A turn-on level is a voltage level that turns on the fourth and fifth transistors. For example, when the third through fifth transistors included in each of the pixels PX are each implemented as a P-channel Metal Oxide Semiconductor (PMOS), the turn-on level may be a low level and the turn-off level may be a high level. Further, when the third through fifth transistors included in each of the pixels PX are each implemented as an N-channel Metal Oxide Semiconductor (NMOS), the turn on level may be a high level and the turn-off level may be a low level. Here, electrons may move through a substrate and form an electric field because of a voltage difference of the scan line that provides the scan signal GW having the turn-off level and the emission control line that provides the emission control signal EM having the turn-on level. Thus, the transistors formed on a substrate may be degraded. When the transistors of the pixel PX are degraded, the threshold voltage of the transistors may be changed. Luminance of the pixel PX may be changed by the change of the threshold voltage of the transistors, and display quality of the display panel 110 may decrease. The pixel PX of the organic light emitting display device 100 of FIG. 1 may maintain the gate voltage provided to the gate electrode of the first transistor during the emission period P4 by including the maintain capacitor so that a change of luminance due to the change of the first through seventh transistors may be minimized.

In exemplary embodiments of the inventive concept, the maintain capacitor may be coupled between the data line and the gate electrode of the first transistor. In exemplary embodiments of the inventive concept, the pixel PX may further include a maintain transistor. The maintain capacitor and the maintain transistor may be coupled between the data line and the gate electrode of the first transistor in series. Here, the maintain transistor may turn on in response to the emission control signal EM during the emission period P4. In exemplary embodiments of the inventive concept, the maintain transistor may be coupled between a third power voltage providing line and the gate electrode of the first transistor. Here, a constant voltage VDC having a predetermined voltage level may be provided through the third power voltage providing line. In exemplary embodiments of the inventive concept, the maintain capacitor may be coupled between a first electrode of the second transistor and the gate electrode of the first transistor. Here, the pixel PX according to an exemplary embodiment of the inventive concept will be described in detail with reference to FIGS. 3 through 7.

The panel driver 120 may provide the scan signal GW, the data signal DATA, a first power voltage ELVDD, a second power voltage ELVSS, and the emission control signal EM. Further, the panel driver 120 may further provide the initialization control signal GI and the bypass signal GB to drive the pixels PX. The panel driver 120 may include a timing controller 121, a scan driver 122, a data driver 123, an emission controller 124, and a power supply 125.

The timing controller 121 may control the scan driver 122, the data driver 123, the emission controller 124, and the power supply 125. The timing controller 121 may provide first through fourth control signals CTL1, CTL2, CTL3, and CTL4 respectively to the scan driver 122, the data driver 123, the emission controller 124, and the power supply 125. In exemplary embodiments of the inventive concept, the timing controller 121 may receive an RGB image signal, a vertical synchronized signal, a horizontal synchronized signal, a main clock signal, and a data enable signal, etc. from an external device (e.g., a graphic controller), and generate the first through fourth control signals CTL1, CTL2, CTL3, and CTL4 based on the above signals and image data IDATA corresponding to the RGB image signal.

The scan driver may provide the scan signal GW, the initialization control signal GI, and the bypass signal GB to the pixels PX of the display panel 110 based on the first control signal CTL1. The scan driver 122 may output the scan signal GW having the turn-on level to the display panel 110 through the scan line during the writing period P3, and may output the scan signal GW having the turn-off level to the display panel 110 through the scan line during the first initialization period P1, the second initialization period P2, and the emission period P4.

In exemplary embodiments of the inventive concept, the scan driver 122 may simultaneously provide the scan signal GW having the turn-on level to the scan lines corresponding to pixel rows during the writing period P3. In exemplary embodiments of the inventive concept, the scan driver 122 may sequentially provide the scan signal GW having the turn-on level to the scan lines corresponding to the pixel rows during the writing period P3.

The scan driver 122 may output the initialization control signal GI having the turn-on level to the display panel 110 through the initialization control lines during the first initialization period P1, and may output the initialization control signal GI having the turn-off level to the display panel 110 through the initialization control line during the second initialization period P2, the writing period P3, and the emission period P4. Further, the scan driver 122 may output the bypass signal GB having the turn-on level to the display panel 110 through the bypass line during the second initialization period P2 and may output the bypass signal GB having the turn-off level to the display panel 110 through the bypass line during the first initialization period P1, the writing period P3, and the emission period P4. Although the scan driver 122 that generates the scan signal GW, the initialization control signal GI, and the bypass signal GB is described with reference to FIG. 1, the organic light emitting display device 100 is not limited thereto. For example, the organic light emitting display device 10 may further include a signal generator that generates the initialization control signal GI and the bypass signal GB.

The data driver 123 may generate the data voltage DATA based on the second control signal CTL2 and the image data IDATA received from the timing controller 121. The data driver 123 may provide the data voltage DATA (e.g., the data signal) to the pixels PX through the data lines during the writing period P3.

The emission controller 124 may provide the emission control signal EM to the emission control lines based on the third control signal CTL3. The emission controller 124 may output the emission control signal EM having the turn-on level to the display panel 110 through the emission control lines during the emission period P4, and the emission control signal EM having the turn-off level to the display panel 110 through the emission control lines during the first initialization period P1, the second initialization period P2, and the writing period P3. In exemplary embodiments of the inventive concept, the emission controller 124 may simultaneously provide the emission control signal EM having the turn-on level to the emission control lines corresponding to the pixel rows during the emission period P4. In exemplary embodiments of the inventive concept, the emission controller 124 may sequentially provide the emission control signal EM having the turn-on level to the emission control lines corresponding to the pixels columns during the emission period P4.

The power supply 125 may provide the first power voltage ELVDD and the second power voltage ELVSS to the display panel 110 through the first power voltage providing lines and the second power voltage providing lines. The first power voltage ELVDD may have one of a first voltage level and a second voltage level. In exemplary embodiments of the inventive concept, the second voltage level may be lower than the first voltage level. The second power voltage ELVSS may be a constant voltage having a predetermined voltage level. In other words, the second power voltage ELVSS may have a direct current (DC) voltage. For example, the second power voltage ELVSS may have a ground voltage or a predetermined negative voltage level. The power supply 125 may provide the initialization voltage VINIT to the display panel 110 through the initialization voltage providing line. The initialization voltage VINIT may be a constant voltage having a predetermined voltage level. The power supply 125 may provide the constant voltage VDC having the predetermined voltage level through the third power voltage providing line when the maintain capacitor is coupled to the third power voltage providing line.

As described above, the organic light emitting display device 100 according to an exemplary embodiment of the inventive concept may maintain the gate voltage applied to the gate electrode of the first transistor during the emission period P4 by including the maintain capacitor. Thus, the luminance that is decreased by the change of the threshold voltage of the transistors included in the pixels PX may be compensated. Therefore, the display quality of the organic light emitting display device 100 may improve.

Figure 3:
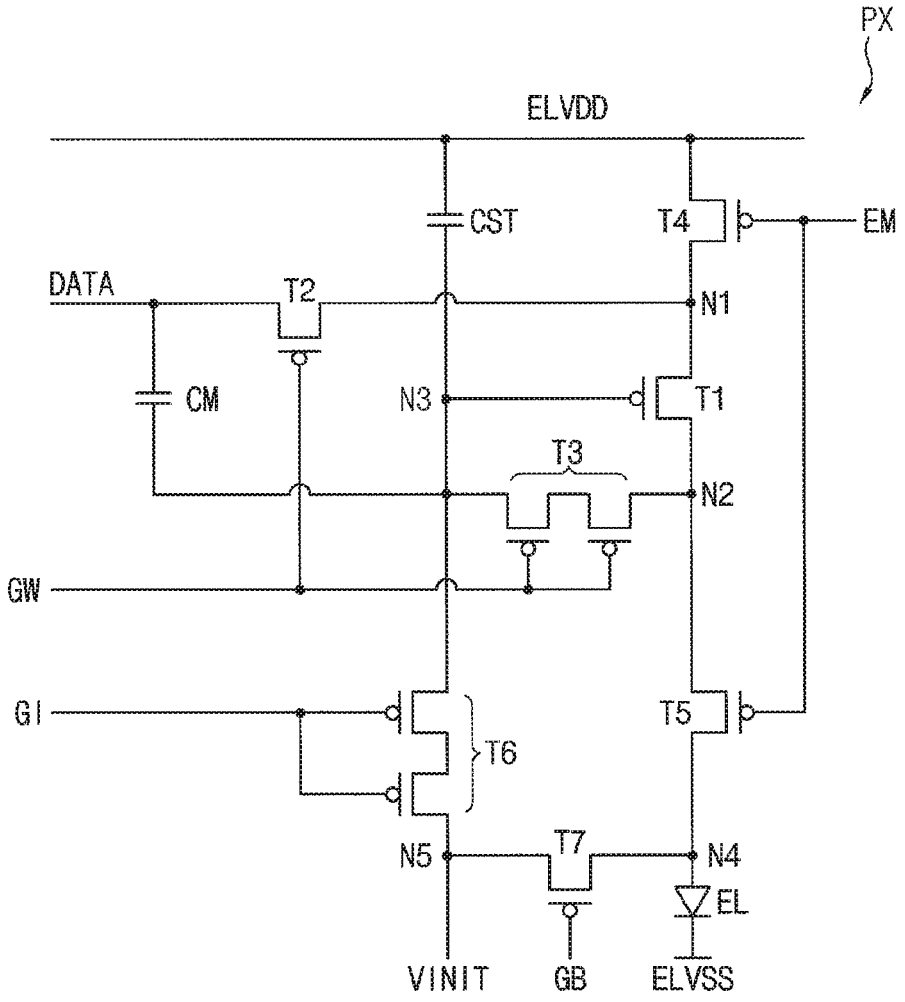
FIG. 3 is a circuit diagram illustrating a pixel included in the organic light emitting display device of FIG. 1 according to an exemplary embodiment of the inventive concept.

FIG. 3 is a circuit diagram illustrating a pixel included in the organic light emitting display device of FIG. 1 according to an exemplary embodiment of the inventive concept.

Referring to FIG. 3, the pixel PX may include a first transistor T1, a second transistor T2, a third transistor T3, a storage capacitor CST, a maintain capacitor CM, a fourth transistor T4, a fifth transistor T5, a sixth transistor T6, a seventh transistor T7, and an organic light emitting diode EL. In exemplary embodiments of the inventive concept, the organic light emitting display device may be driven in a simultaneous emission method. In exemplary embodiments of the inventive concept, the organic light emitting display device may be driven in a progressive emission method.

The first transistor T1 may generate the driving current in response to the data voltage DATA. The first transistor T1 may be coupled between a first node N1 and a second node N2 and control the driving current by being coupled to a third node N3. The first transistor T1 may include a first electrode, a second electrode, and a gate electrode. Here, the first electrode may be a source electrode and the second electrode may be a drain electrode. The first electrode of the first transistor T1 may correspond to the first node N1, the second electrode of the first transistor T1 may correspond to the second node N2, and the gate electrode may correspond to the third node N3. The first transistor T1 may generate the driving current in response to the data voltage DATA stored in the storage capacitor CST. The first transistor T1 may provide the driving current to the anode electrode of the organic light emitting diode EL when the fourth transistor T4 and the fifth transistor T5 turn on.

The second transistor T2 may transfer the data voltage DATA provided through the data line in response to the scan signal GW provided through the scan line. The second transistor T2 may be coupled between the data line and the first node N1 and receive the scan signal GW by a gate electrode. The second transistor T2 may include a first electrode, a second electrode, and the gate electrode. The first electrode of the second transistor T2 may be coupled to the data line, the second electrode of the second transistor T2 may correspond to the first node N1, and the gate electrode of the second transistor T2 may be coupled to the scan line. The second transistor T2 may turn on in response to the scan signal GW having the turn-on level. When the second transistor T2 turns on, the data voltage DATA provided through the data line may be provided to the first node N1. The second transistor T2 may turn on in the writing period P3 and transfer the data voltage DATA to the first node N1.

The third transistor T3 may compensate the threshold voltage of the first transistor T1 in response to the scan signal GW provided through the scan line. The third transistor T3 may be coupled between the second node N2 and the third node N3 and receive the scan signal by a gate electrode. The third transistor T3 may have a first electrode, a second electrode, and the gate electrode. The first electrode of the third transistor T3 may correspond to the third node N3, the second electrode of the third transistor T3 may correspond to the second node N2, and the gate electrode may be coupled to the scan line. The third transistor T3 may turn on in response to the scan signal GW having the turn-on level. When the third transistor T3 turns on, the second node N2 and the third node N3 may be coupled and the first transistor T1 may be a diode connection. Thus, the data voltage DATA that includes the threshold voltage of the first transistor T1 may be transferred to the storage capacitor CST. The third transistor T3 may turn on and compensate the threshold voltage of the first transistor T1 in the writing period P3.

The storage capacitor CST may be coupled between the first power voltage providing line and the gate electrode of the first transistor T1, and store the data voltage DATA. The first electrode of the storage capacitor CST may correspond to the third node N3 and the second electrode of the storage capacitor CST may be coupled to the first power voltage providing line. The storage capacitor CST may store the data voltage DATA provided during the writing period P3.

The maintain capacitor CM may be coupled between the data line and the gate electrode of the first transistor T1, and maintain the gate voltage of the first transistor T1 during the emission period P4 of the pixel PX. The maintain capacitor CM may include a first electrode and a second electrode. The first electrode of the maintain capacitor CM may correspond to the third node N3 and the second electrode of the maintain capacitor CM may be coupled to the data line. The maintain capacitor CM may maintain the gate voltage applied to the gate electrode of the first transistor T1 during the emission period P4.

The fourth transistor T4 and the fifth transistor T5 may provide the driving current to the organic light emitting diode EL in response to the emission control signal EM provided through the emission control line. The fourth transistor T4 may be coupled between the first power voltage providing line and the first node N1, and receive the emission control signal EM by a gate electrode. The fourth transistor T4 may include a first electrode, a second electrode, and the gate electrode. The first electrode of the fourth transistor T4 may correspond to the first node N1, the second electrode may be coupled to the first power voltage providing line, and the gate electrode may be coupled to the emission control line. The fourth transistor T4 may turn on in response to the emission control signal EM having the turn-on level. The fourth transistor T4 may turn on and transfer the first power voltage ELVDD to the first electrode of the first transistor T1 in the emission period P4. The fifth transistor T5 may be coupled between the second node N2 and a fourth node N4, and receive the emission control signal EM by a gate electrode. The fifth transistor T5 may include a first electrode, a second electrode, and the gate electrode. The first electrode of the fifth transistor T5 may correspond to the fourth node N4 (e.g., the anode electrode of the organic light emitting diode EL), the second electrode of the fifth transistor T5 may correspond to the second node N2 (e.g., the second electrode of the first transistor T1), and the gate electrode may be coupled to the emission control line. The fifth transistor T5 may turn on and transfer the driving current generated in the first transistor T1 to the anode electrode of the organic light emitting diode EL in the emission period P4.

The sixth transistor T6 may transfer the initialization voltage VINIT provided through the initialization voltage providing line to the gate electrode of the first transistor T1 in response to the initialization control signal GI provided through the initialization control line. The sixth transistor T6 may be coupled between a fifth node N5 and the third node N3, and may receive the initialization control signal GI by a gate electrode. The sixth transistor T6 may include a first electrode, a second electrode, and the gate electrode. The first electrode of the sixth transistor T6 may correspond to the third node N3, the second electrode of the sixth transistor T6 may correspond to the fifth node N5 (e.g., the initialization voltage providing line), and the gate electrode of the sixth transistor T6 may be coupled to the initialization control line. The sixth transistor T6 may turn on in response to the initialization control signal GI. The sixth transistor T6 may turn on and transfer the initialization voltage VINIT to the third node N3 (e.g., the gate electrode of the first transistor T1) so that the gate electrode of the first transistor T1 may be initialized in the first initialization period P1.

The seventh transistor T7 may transfer the initialization voltage VINIT provided through the initialization voltage providing line to the anode electrode of the organic light emitting diode EL in response to the bypass signal GB provided through the bypass line. The seventh transistor T7 may be coupled between the fourth node N4 (e.g., the anode electrode of the organic light emitting diode EL) and the fifth node N5 (e.g., the initialization voltage providing line), and receive the bypass signal GB by a gate electrode. The seventh transistor T7 may include a first electrode, a second electrode, and the gate electrode. The first electrode of the seventh transistor T7 may be coupled to the initialization voltage providing line, the second electrode of the seventh transistor T7 may be coupled to the anode electrode of the organic light emitting diode EL, and the gate electrode of the seventh transistor T7 may be coupled to the bypass line. The seventh transistor T7 may turn on in response to the bypass signal GB having the turn-on level. The seventh transistor T7 may turn on and transfer the initialization voltage VINIT to the anode electrode of the organic light emitting diode EL in the second initialization period P2 so that the anode electrode of the organic light emitting diode EL may be initialized.

The organic light emitting diode EL may emit light based on the driving current during the emission period P4. The organic light emitting diode EL may be coupled between the second electrode of the fifth transistor T5 and the second power voltage providing line. The organic light emitting diode EL may include the anode electrode and a cathode electrode. The anode electrode of the organic light emitting diode EL may be coupled to the second electrode of the fifth transistor T5 and the first electrode of the seventh transistor T7, and the cathode electrode may be coupled to the second power voltage providing line.

Although the pixel PX that includes he first through seventh transistors T1 through T7, implemented as PMOS transistors, is described with reference to FIG. 3, the first through seventh transistors T1 through T7 are not limited thereto. For example, each of the first through seventh transistors T1 through T7 may be implemented as NMOS transistors. Alternatively, each of the first through seventh transistors T1 through T7 may be implemented as a low temperature poly silicon (LTPS) thin film transistor, an oxide thin film transistor, or a low temperature polycrystalline oxide (LTPO) thin film transistor.

FIGS. 4A through 4D are circuit diagrams illustrating for describing an operation of the pixel of FIG. 3 according to an exemplary embodiment of the inventive concept.

Referring back to FIG. 2, one frame cycle may include the first initialization period P1, the second initialization period P2, the writing period P3, and the emission period P4.

Figure 4A:
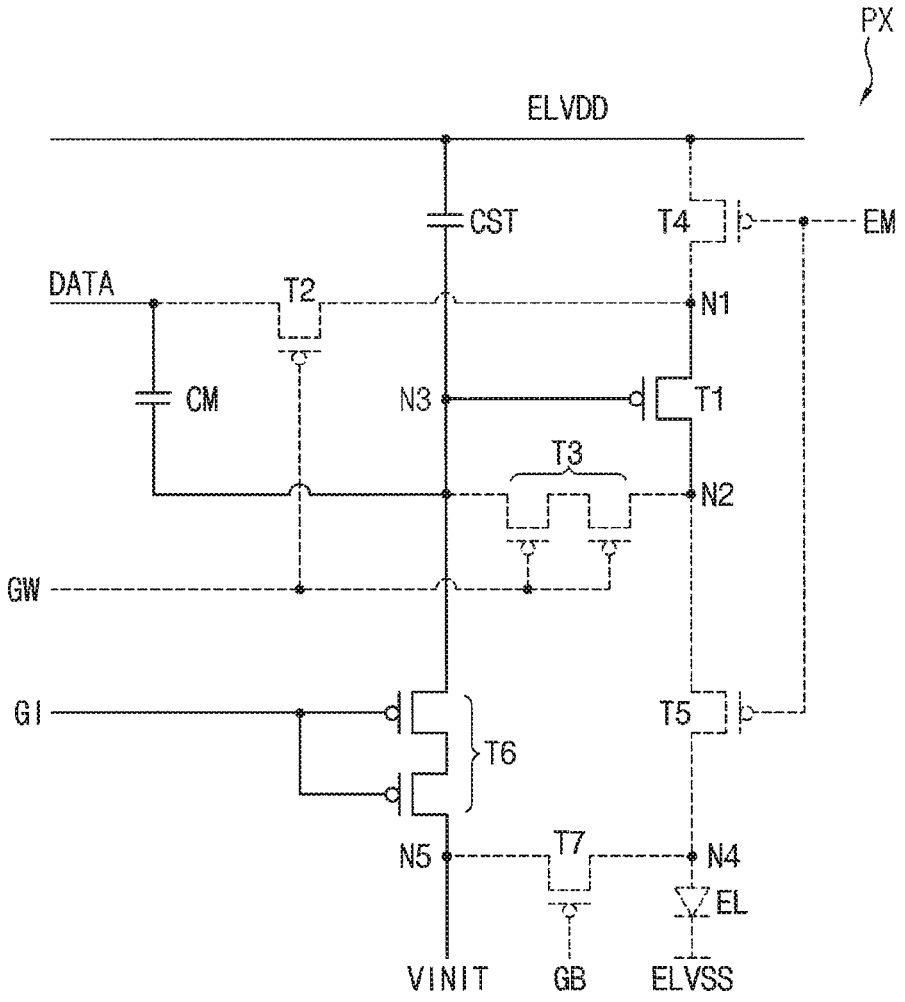
FIGS. 4A through 4D are circuit diagrams illustrating for describing an operation of the pixel of FIG. 3 according to an exemplary embodiment of the inventive concept.

Referring to FIG. 4A, the initialization control signal GI having the turn-on level, the bypass signal GB having the turn-off level, the scan signal GW having the turn-off level, and the emission control signal EM having the turn-off level may be provided to the pixel PX in the first initialization period P1. The sixth transistor T6 may turn on in response to the initialization control signal GI having the turn-on level, the seventh transistor T7 may turn off in response to the bypass signal GB having the turn-off level, the second and third transistors T2 and T3 may turn off in response to the scan signal GW having the turn-off level, and the fourth and fifth transistors T4 and T5 may turn off in response to the emission control signal EM having the turn-off level. When the sixth transistor T6 turns on, the initialization voltage VINIT provided through the initialization voltage providing line may be provided to the third node N3, (e.g., the gate electrode of the first transistor T1) and the gate electrode of the first transistor T1 may be initialized as the voltage level of the initialization voltage VINIT.

Figure 4B:
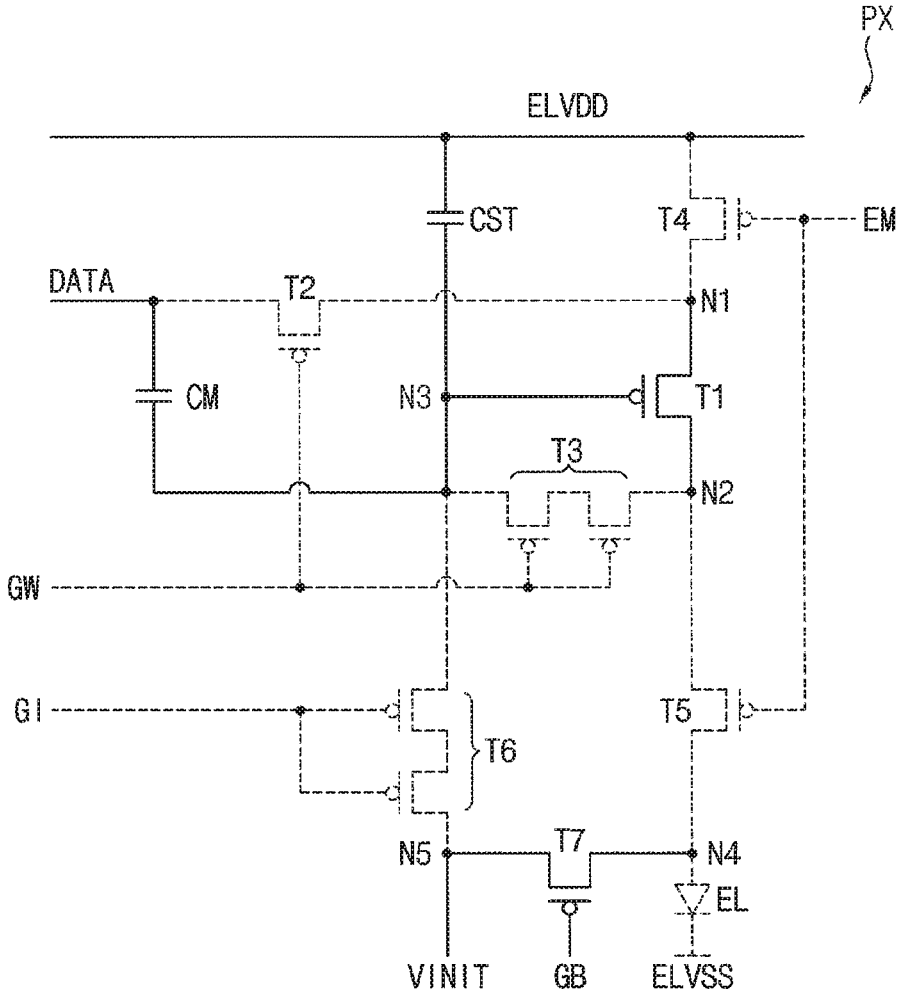

Referring to FIG. 4B, the bypass signal GB having the turn-on level, the initialization control signal GI having the turn-off level, the scan signal GW having the turn-off level, and the emission control signal EM having the turn-off level may be provided to the pixel PX in the second initialization period P2. The seventh transistor T7 may turn on in response to the bypass signal GB having the turn-on level, the sixth transistor T6 may turn off in response to the initialization control signal GI having the turn-off level, the second and third transistors T2 and T3 may turn off in response to the scan signal GW having the turn-off level, and the fourth and fifth transistors T4 and T5 may turn off in response to the emission control signal EM having the turn-off level. When the seventh transistor T7 turns on, the initialization voltage VINIT provided through the initialization voltage providing line may be provided to the anode electrode of the organic light emitting diode EL and the anode electrode of the organic light emitting diode EL may be initialized as the voltage level of the initialization voltage VINIT.

Figure 4C:
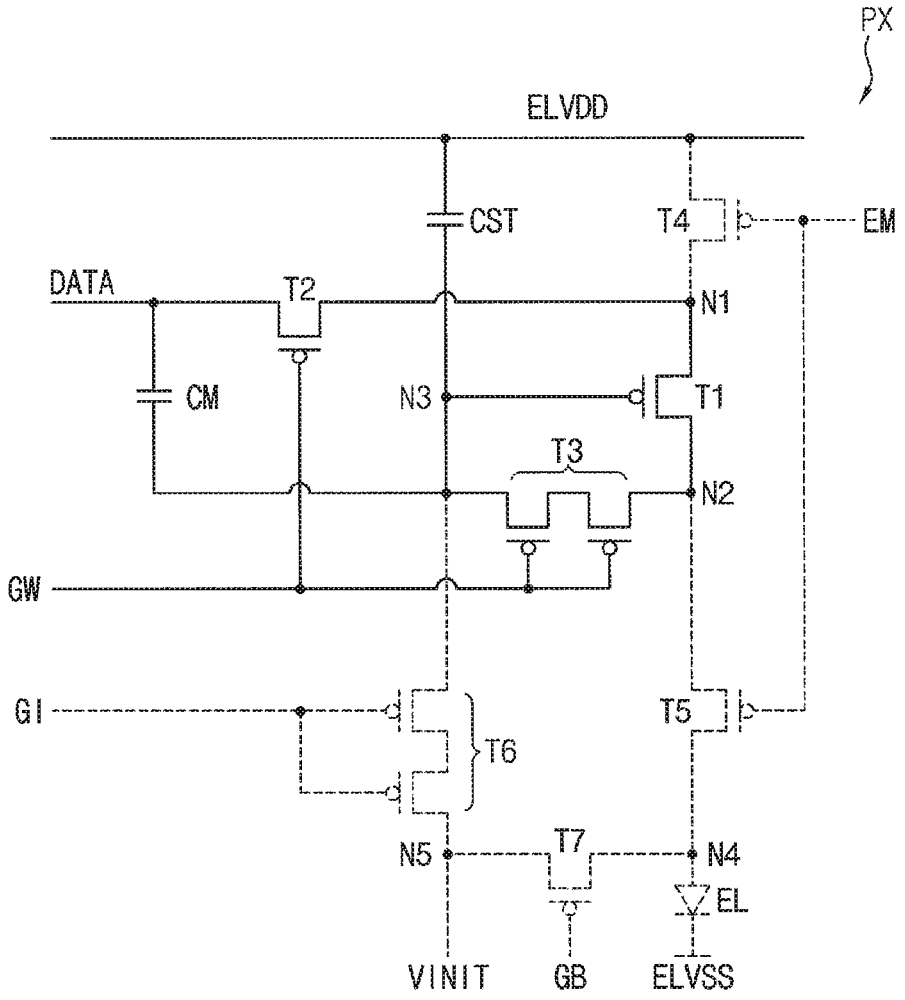

Referring to FIG. 4C, the scan signal GW having the turn-on level, the initialization control signal GI having the turn-off level, the bypass signal GB having the turn-off level, and the emission control signal EM having the turn-off level may be provided to the pixel PX during the writing period P3. The second transistor T2 and the third transistor T3 may turn on in response to the scan signal GW having the turn-on level, the sixth transistor may turn off in response to the initialization control signal GI having the turn-off level, the seventh transistor T7 may turn off in response to the bypass signal GB having the turn-off level, and the fourth and fifth transistors T4 and T5 may turn off in response to the emission control signal EM having the turn-off level. When the second transistor T2 turns on, the data voltage DATA provided through the data line may be provided to the first node N1. When the third transistor T3 turns on, the second node N2 and the third node N3 may be coupled. In other words, the second electrode of the first transistor T1 and the gate electrode of the first transistor T1 may be coupled so that the first transistor T1 may be a diode connection. Accordingly, a voltage corresponding to a sum of the data voltage DATA and the threshold voltage of the first transistor T1 may be applied to the third node N3. Thus, the voltage corresponding to the sum of the data voltage DATA and the threshold voltage of the first transistor T1 may be stored in the storage capacitor CST, and some voltage may be stored in the maintain capacitor CM.

Figure 4D:
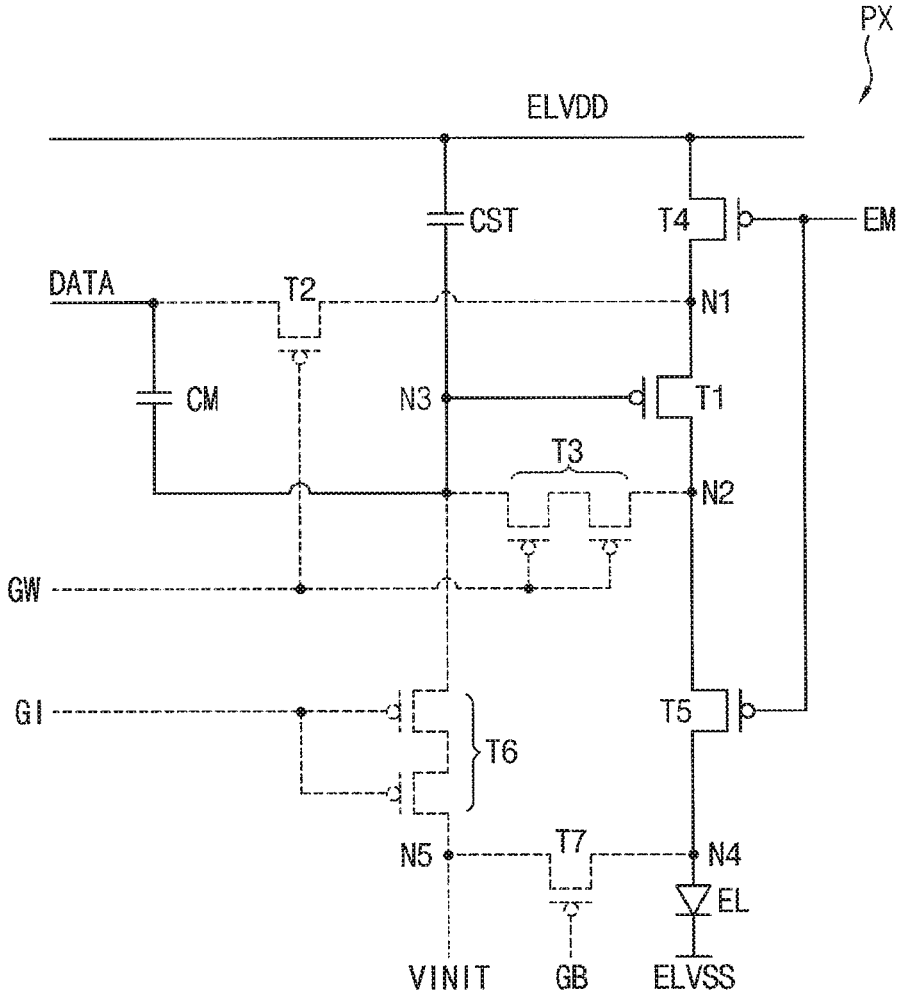

Referring to FIG. 4D, the emission control signal EM having the turn-on level, the initialization control signal GI having the turn-off level, the bypass signal GB having the turn-off level, and the scan signal GW having the turn-off level may be provided to the pixel PX during the emission period P4. The fourth transistor T4 and the fifth transistor T5 may turn on in response to the emission control signal EM having the turn-on level, the sixth transistor T6 may turn off in response to the initialization control signal GI having the turn-off level, the seventh transistor T7 may turn off in response to the bypass signal GB having the turn-off level, and the second and third transistors T3 may turn off in response to the scan signal having the turn-off level. When the fourth transistor T4 and the fifth transistor T5 turn on, the driving current generated in the first transistor T1 in response to the gate voltage applied to the gate electrode of the first transistor T1 may be provided to the anode electrode of the organic light emitting diode EL. Here, the maintain capacitor CM may be coupled to the gate electrode of the first transistor T1 and may maintain the voltage level of the gate voltage applied to the gate electrode of the first transistor T1. When the pixel PX of FIG. 4D does not include the maintain capacitor CM, the third transistor T3 may turn off and the second electrode of the storage capacitor CST may be floating. The maintain capacitor CM may be coupled to the second electrode of the storage capacitor CST and maintain the voltage level of the gate voltage applied to the gate electrode of the first transistor T1 during the emission period P4 in which the organic light emitting diode EL emits light.

As described above, the pixel PX according to an exemplary embodiment of the inventive concept may include the maintain capacitor CM disposed between the data line and gate electrode of the first transistor T1 (e.g., the driving transistor). Thus, the voltage level of the gate voltage applied to the gate electrode of the first transistor T1 may be maintained during the emission period P4.

Figure 5:
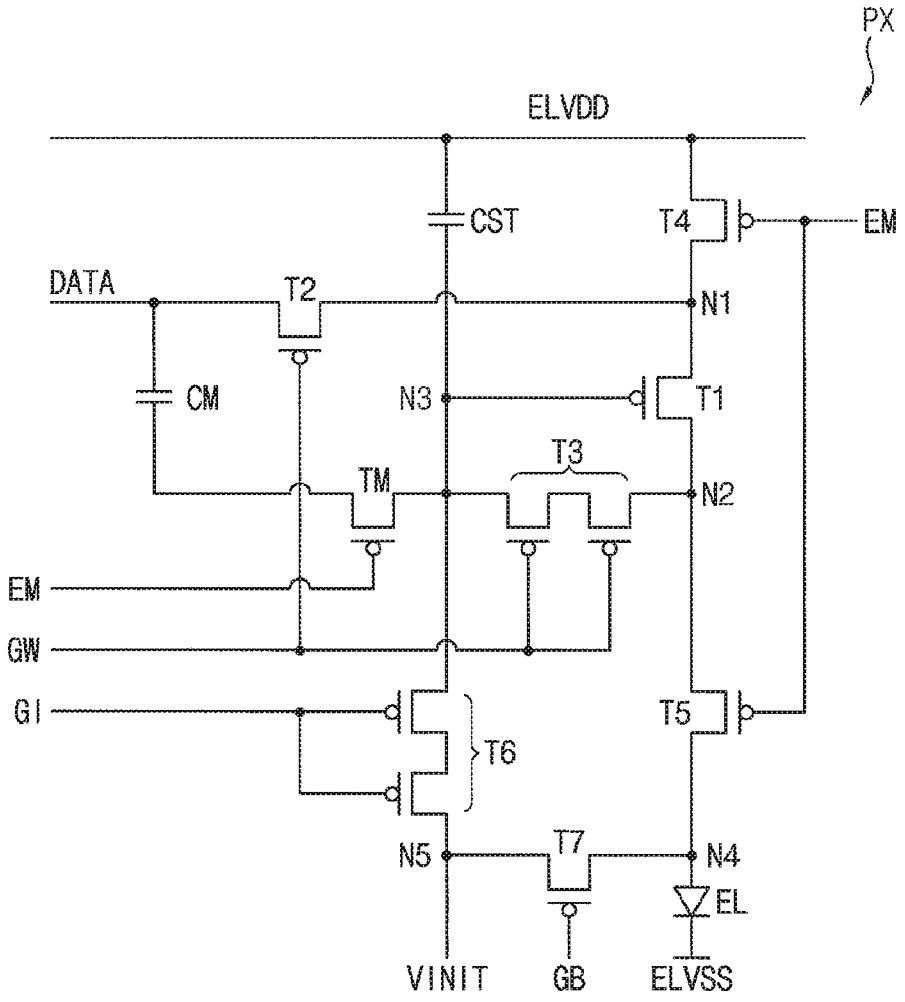
FIG. 5 is a circuit diagram illustrating a pixel included in the organic light emitting display device of FIG. 1 according to an exemplary embodiment of the inventive concept.

FIG. 5 is a circuit diagram illustrating a pixel included in the organic light emitting display device of FIG. 1 according to an exemplary embodiment of the inventive concept.

Referring to FIG. 5, the pixel PX may include the first transistor T1, the second transistor T2, the third transistor T3, the storage capacitor CST, the maintain capacitor CM, the fourth transistor T4, the fifth transistor T5, the sixth transistor T6, the seventh transistor T7, the organic light emitting diode EL, and a maintain transistor TM. The pixel PX of FIG. 5 may have substantially the same structure as the pixel PX of FIG. 3 except that the pixel PX of FIG. 5 includes the maintain transistor TM coupled between the maintain capacitor CM and the third node N3.

The maintain transistor TM may be coupled between the maintain capacitor CM and the gate electrode of the first transistor T1 (e.g., the third node N3). The maintain transistor TM may include a first electrode, a second electrode, and a gate electrode. The first electrode of the maintain transistor TM may be coupled to the first electrode of the maintain capacitor CM, the second electrode of the maintain transistor TM may correspond to the third node N3, and the gate electrode of the maintain transistor TM may be coupled to the emission control line. The maintain capacitor CM may turn on in response to the emission control signal EM having the turn-on level. The maintain transistor TM may turn on and transfer the voltage stored in the maintain capacitor CM to the gate electrode of the first transistor T1 in the emission period P4.

The maintain transistor TM may turn off in the first initialization period P1, the second initialization period P2, and the writing period P3, and turn on in the emission period P4. When the maintain capacitor CM is coupled to the third node N3 in the first initialization period P1, the second initialization period P2, and the writing period P3, the gate voltage of the gate electrode of the first transistor T1 may be changed because of a coupling phenomenon of the maintain capacitor CM. As described, the maintain transistor TM may turn off in the first initialization period P1, the second initialization period P2, and the writing period P3, and may not couple the maintain capacitor CM and the third node N3. Thus, the change of the gate voltage of the first transistor T1 that occurs due the coupling of the maintain capacitor CM in the first initialization period P1, the second initialization period P2, and the writing period P3 may be prevented. Further, the maintain transistor TM may turn on in the emission period P4 and couple the maintain capacitor CM and the third node N3. Thus, the voltage level of the gate voltage applied to the gate electrode of the first transistor T1 may be maintained.

Although the maintain transistor TM, implemented as a PMOS transistor that is substantially the same as the first through seventh transistors T1 through T7, is described with reference to FIG. 5, the maintain transistor TM is not limited thereto. For example, the maintain transistor TM may be implemented as an NMOS transistor. In this case, an inversion signal of the emission control signal EM may be provided to the gate electrode of the maintain transistor TM.

Figure 6:
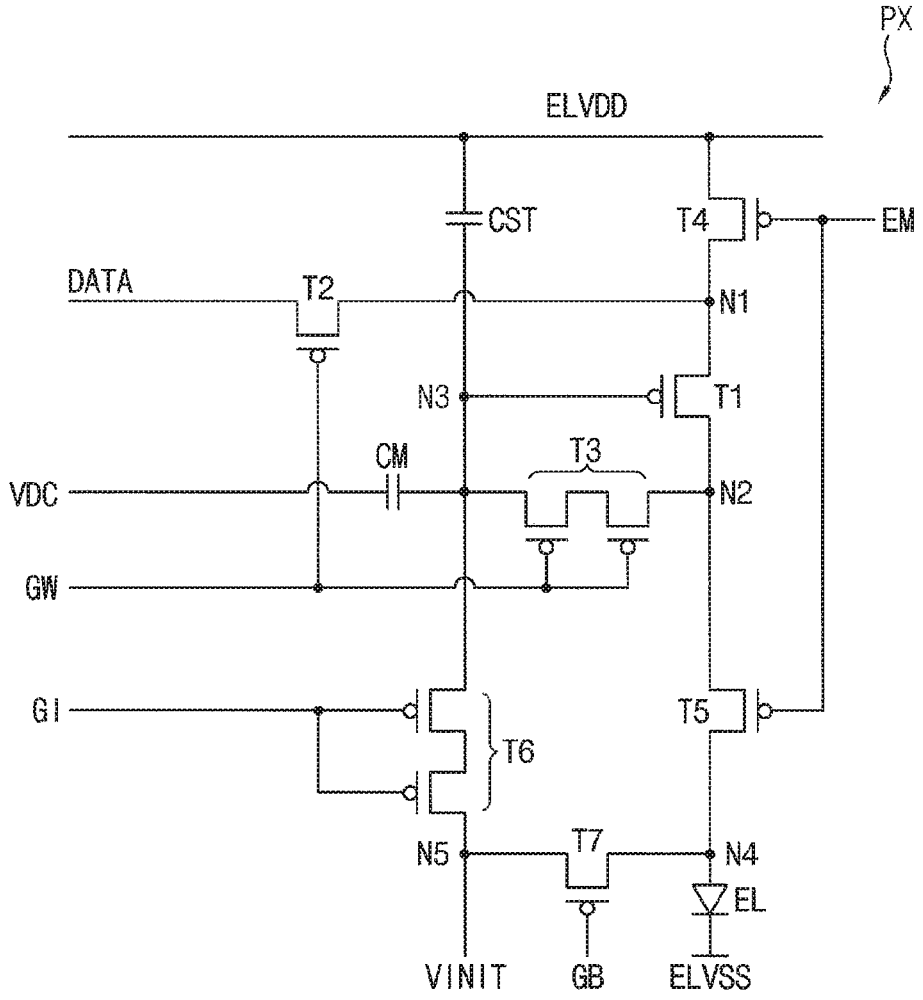
FIG. 6 is a circuit diagram illustrating a pixel included in the organic light emitting display device of FIG. 1 according to an exemplary embodiment of the inventive concept.

FIG. 6 is a circuit diagram illustrating a pixel included in the organic light emitting display device of FIG. 1 according to an exemplary embodiment of the inventive concept.

Referring to FIG. 6, the pixel PX may include the first transistor T1, the second transistor T2, the third transistor T3, the storage capacitor CST, the maintain capacitor CM, the fourth transistor T4, the fifth transistor T5, the sixth transistor T6, the seventh transistor T7, and the organic light emitting diode EL. The pixel PX of FIG. 6 may have substantially the same structure as the pixel PX of FIG. 3 except that the second electrode of the maintain capacitor CM is coupled to a third power voltage providing line.

The maintain capacitor CM may be coupled between the third power voltage providing line and the gate electrode of the first transistor T1. The maintain capacitor CM may include the first electrode and the second electrode. The first electrode of the maintain capacitor CM may correspond to the third node N3 and the second electrode may be coupled to the third power voltage providing line. The constant voltage VDC having a predetermined voltage level may be provided through the third power voltage providing line during the emission period P4. The maintain capacitor CM may maintain the gate voltage applied to the gate electrode of the first transistor T1 during the emission period P4. The third power voltage providing line may be coupled to the voltage supply and may provide the constant voltage VDC to the pixel PX.

Figure 7:
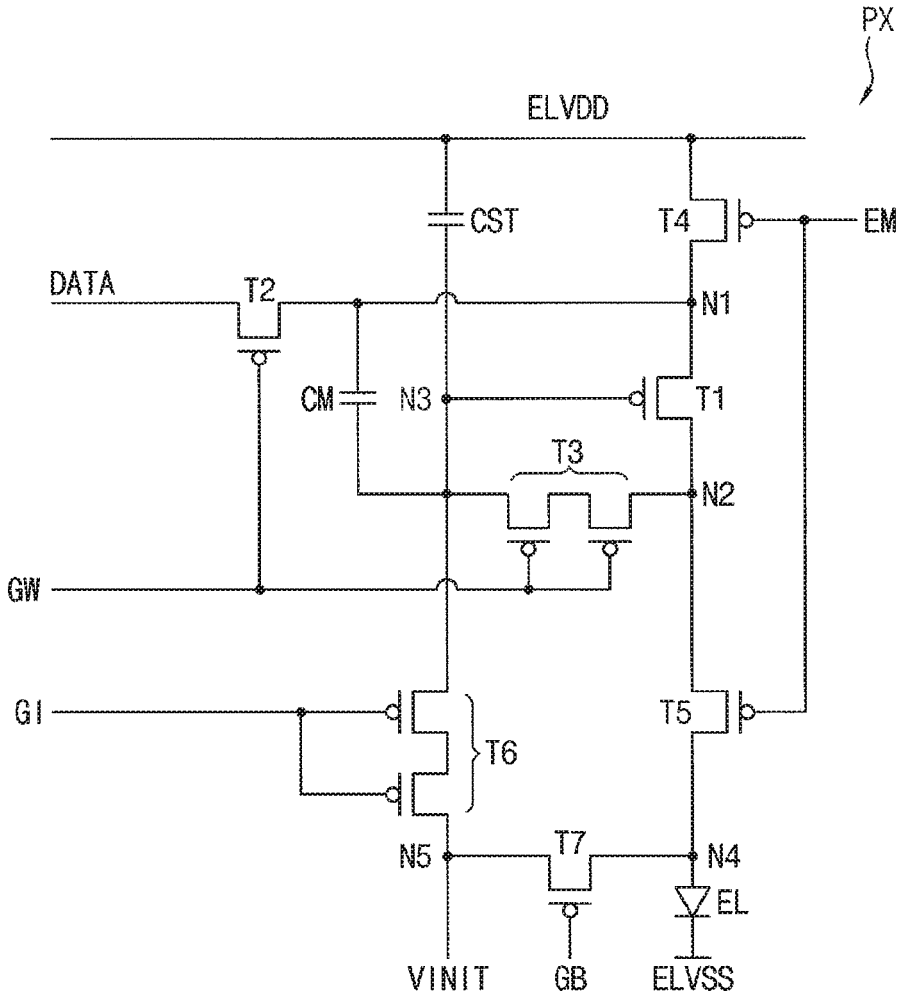
FIG. 7 a circuit diagram illustrating a pixel included in the organic light emitting display device of FIG. 1 according to an exemplary embodiment of the inventive concept.

FIG. 7 is a circuit diagram illustrating a pixel included in the organic light emitting display device of FIG. 1 according to an exemplary embodiment of the inventive concept.

Referring to FIG. 7, the pixel PX may include the first transistor T1, the second transistor T2, the third transistor T3, the storage capacitor CST, the maintain capacitor CM, the fourth transistor T4, the fifth transistor T5, the sixth transistor T6, the seventh transistor T7, the organic light emitting diode EL, and the maintain transistor TM. The pixel PX of FIG. 7 may have substantially the same structure as the pixel PX of FIG. 3 except that the second electrode of the maintain capacitor CM corresponds to the first node N1.

The maintain capacitor CM may be coupled between the first node N1 and the gate electrode of the first transistor T1. The maintain capacitor CM may include the first electrode and the second electrode. The first electrode of the maintain capacitor CM may correspond to the third node N3 and the second electrode may correspond to the first node N1. The maintain capacitor CM may be coupled to the gate electrode of the first transistor T1 and maintain the voltage level of the gate voltage applied to the gate electrode of the first transistor T1.

Figure 8:
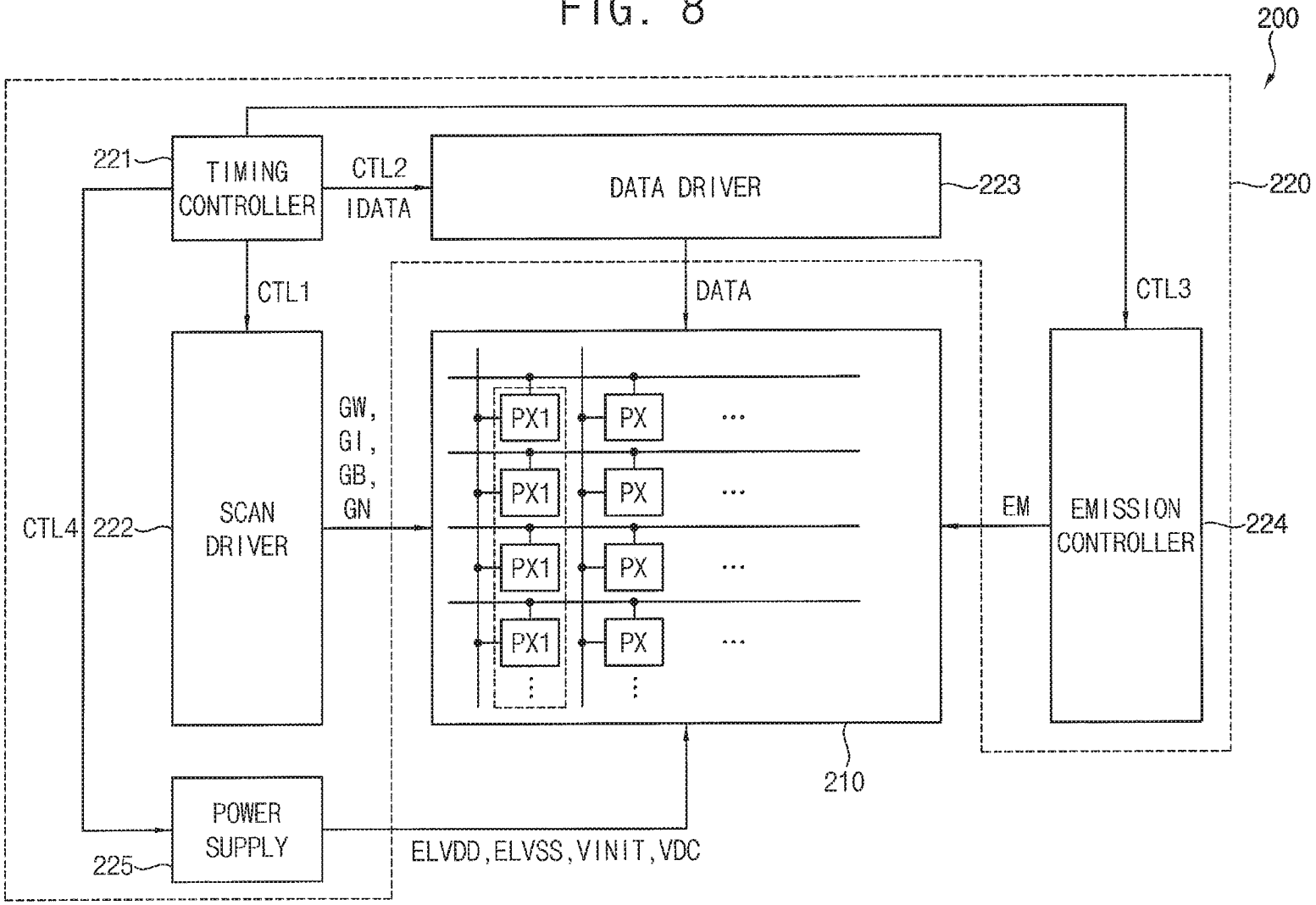
FIG. 8 is a diagram illustrating an organic light emitting display device according to an exemplary embodiment of the inventive concept.
Figure 9:
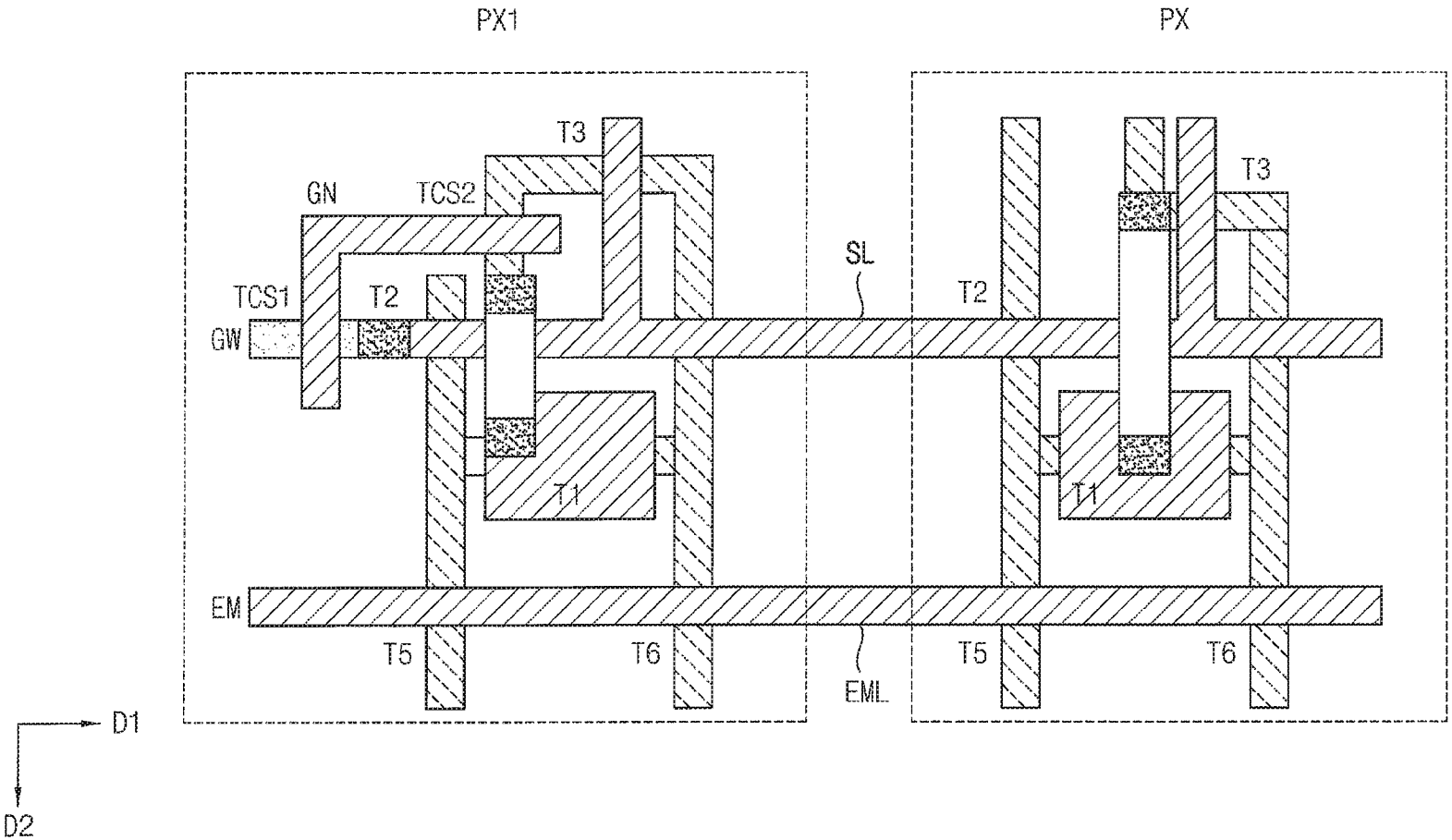
FIG. 9 is a diagram illustrating a layout of a pixel included in the organic light emitting display device of FIG. 8 according to an exemplary embodiment of the inventive concept.

FIG. 8 is a diagram illustrating an organic light emitting display device according to an exemplary embodiment of the inventive concept, and FIG. 9 is a diagram illustrating a layout of a pixel included in the organic light emitting display device of FIG. 8 according to an exemplary embodiment of the inventive concept.

Referring to FIG. 8, an organic light emitting display device 200 may include a display panel 210 and a panel driver 220.

The display panel 210 may include the plurality of pixels PX, the plurality of scan lines, the plurality of data lines, the first power voltage providing line, the second power voltage providing line, the plurality of emission control lines, and a plurality of scan control lines. The display panel 210 may further include the initialization control line, the initialization voltage providing line, and the bypass line.

Each of the pixels PX may include the first transistor, the second transistor, the storage capacitor, the third transistor, the maintain capacitor, the organic light emitting diode, the fourth transistor, and the fifth transistor. Each of the pixels may further include the sixth transistor and the seventh transistor.

The first transistor may generate the driving current in response to the data voltage DATA. In other words, the first transistor may be the driving transistor of the pixels PX. The second transistor may transfer the data voltage DATA provided through the data line in response to the scan signal GW provided through the scan line. The storage capacitor may be coupled between the first power voltage providing line and a gate electrode of the first transistor, and store the data voltage DATA. The third transistor may compensate a threshold voltage of the first transistor in response to the scan signal GW. The maintain capacitor may be coupled to the gate electrode of the first transistor and maintain the gate voltage of the first transistor during an emission period of the pixel PX. The fourth and fifth transistors may provide the driving current to the organic light emitting diode in response to the emission control signal EM provided through the emission control line. The sixth transistor may transfer the initialization voltage VINIT provided through the initialization voltage providing line to the gate electrode of the first transistor in response to the initialization control signal GI provided through the initialization control line. The seventh transistor may transfer the initialization voltage VINIT provided through the initialization voltage providing line to the anode electrode of the organic light emitting diode in response to the bypass signal GB provided through the bypass line.

Pixels PX1 arranged in a first column of the pixels PX in the display panel 210 may each further include a first scan control transistor and a second scan control transistor. The first scan control transistor may block the scan signal GW provided to a gate electrode of the second transistor and a gate electrode of the third transistor in response to a scan control signal provided through the scan control line during the emission period. The second scan control transistor may block the connection of the storage capacitor and a first electrode of the third transistor in response to the scan control signal during the emission period.

Referring to FIG. 9, the pixels PX1 arranged in the first column of the pixels PX in the display panel 210 may each include a first scan control transistor TCS1 and a second scan control transistor TCS2. Electrons may move through a substrate and form an electric field because of a voltage difference of the scan line that provides the scan signal GW having the turn-off level and the emission control line that provides the emission control signal EM having the turn-on level. Thus, the transistors formed on the substrate may be degraded. The first scan control transistor TCS1 may block the connection of the scan line and the second and third transistors T2 and T3 during the emission period P4. The second scan control transistor TCS2 may block the connection of the storage capacitor and the third transistor T3 during the emission period P4. The first scan control transistor TCS1 and the second scan control transistor TCS2 may turn on or turn off in response to a scan control signal GN. The scan control signal GN may be an inversion signal of the emission control signal EM. Thus, the first scan control transistor TCS1 and the second scan control transistor TCS2 may turn off in the emission period P4. The electric field that occurs due the voltage difference of the scan line that provides the scan signal GW having the turn-off level and the emission control line EML that provides the emission control signal EM having the turn-on level may not be formed in the substrate because the scan signal GW having the turn-off level is not provided to the pixels PX1 and PX during the emission period P4. Thus, the degradation of the pixels may be reduced.

As illustrated in FIG. 9, a scan line SL and an emission control line EML may extend in a first direction D1 and may be coupled to the pixels PX1 and PX arranged in the first direction D1. The pixels PX1 arranged in the first column of the pixels PX of the display panel 210 may each include the first scan control transistor TCS1 and the second scan control transistor TCS2, and block the connection of the scan line SL and the second and third transistors T2 and T3. Thus, the scan signal GW having the turn-off level may not be provided to the pixels PX1 and the pixels PX adjacent to the pixels PX1 arranged in the first direction D1. 'Hereinafter, the pixel PX according to an exemplary embodiment of the inventive concept will be described in detail with reference to FIGS. 10 through 12.

The panel driver 220 may provide the scan signal GW, the data voltage DATA, the first power voltage ELVDD, the second power voltage ELVSS, the emission control signal EM, and the scan control signal GN to drive the pixels PX. Further, the panel driver 220 may provide the initialization control signal GI and the bypass signal GB. The panel driver 220 may include a timing controller 221, a scan driver 222, a data driver 223, an emission controller 224, and a power supply 225.

The timing controller 221 may control the scan driver 222, the data driver 223, the emission controller 224, and the power supply 225. The timing controller 221 may provide the first through fourth control signals CTL1, CTL2, CTL3, and CTL4 to the scan driver 222, the data driver 223, the emission controller 224, and the power supply 225, respectively, and control each of the scan driver 222, the data driver 223, the emission controller 224, and the power supply 225. In exemplary embodiments of the inventive concept, the timing controller 221 may receive an RGB image signal, a vertical synchronized signal, a horizontal synchronized signal, a main clock signal, and a data enable signal, etc. from an external device (e.g., a graphic controller), and generate the first through fourth control signals CTL1, CTL2, CTL3, and CTL4 based on the above signals and image data IDATA corresponding to the RGB image signal.

The scan driver 222 may provide the scan signal GW, the initialization control signal GI, the bypass signal GB, and the scan control signal GN to the pixels PX in the display panel 210 based on the first control signal CTL1. The scan driver 222 may output the scan signal having the turn-on level to the display panel 210 through the scan lines during the writing period P3, and output the scan signal GW having the turn-off level to the display panel 210 through the scan lines during the first initialization period P1, the second initialization period P2, and the emission period P4. In exemplary embodiments of the inventive concept, the scan driver 222 may simultaneously provide the scan signal GW having the turn-on level to the scan lines corresponding to pixel rows during the writing period P3. In exemplary embodiments of the inventive concept, the scan driver 122 may sequentially provide the scan signal having the turn-on level to the scan lines corresponding to the pixel rows during the writing period P3.

The scan driver 222 may output the initialization control signal GI having the turn-on level to the display panel 210 through the initialization control line in the first initialization period P1, and provide the initialization control signal GI having the turn-off level to the display panel 210 through the initialization control line during the second initialization period P2, the writing period P3, and the emission period P4.

Further, the scan driver 222 may output the bypass signal GB having the turn-on level to the display panel 210 through the bypass line during the second initialization period P2 and output the bypass signal GB having the turn-off level to the display panel 210 through the bypass line during the first initialization period P1, the writing period P3, and the emission period P4. Further, the scan driver 222 may output the scan control signal GN that has the turn-on level in the first initialization period P1, the second initialization period P2, and the writing period P3 and may output the scan control signal GN that has the turn-off level in the emission period P3, to the display panel 210 through the scan control lines. Although the scan driver 222 that generates the scan signal GW, the initialization control signal GI, the bypass signal GB, and the scan control signal GN is described with reference to FIG. 8, the organic light emitting display device 200 is not limited thereto. For example, the organic light emitting display device 200 may further include a signal generator that generates the initialization control signal GI, the bypass signal GB, and the scan control signal GN.

The data driver 223 may generate the data voltage DATA (e.g., the data signal) based on the second control signal CTL2 and the image data IDATA provided from the timing controller 221. The data driver 223 may provide the data voltage DATA to the pixels PX through the data line during the writing period P3.

The emission controller 224 may provide the emission control signal EM to the emission control lines based on the third control signal CTL3. The emission controller may output the emission control signal EM having the turn-on level to the display panel 210 through the emission control lines during the emission period P4, and output the emission control signal EM having the turn-off level to the display panel 210 through the emission control lines during the first initialization period P1, the second initialization period P2, and the writing period P3. In exemplary embodiments of the inventive concept, the emission controller 224 may simultaneously provide the emission control signal EM having the turn-on level to the emission control lines corresponding to the pixel rows during the emission period P4. In exemplary embodiments of the inventive concept, the emission controller 224 may sequentially provide the emission control signal EM having the turn-on level to the emission control lines corresponding to the pixels columns during the emission period P4.

The power supply 225 may provide the first power voltage ELVDD and the second power voltage ELVSS through the first power voltage providing line and the second power voltage providing line. The first power voltage ELVDD may have one of a first voltage level and a second voltage level. In exemplary embodiments of the inventive concept, the second voltage level may be lower than the first voltage level. The second power voltage ELVSS may be a constant voltage having a predetermined voltage level. In other words, the second power voltage ELVSS may have a direct current (DC) voltage. For example, the second power voltage ELVSS may have a ground voltage or a predetermined negative voltage level.

The power supply 225 may provide the initialization voltage VINIT to the display panel 210 through the initialization voltage providing line. The initialization voltage VINIT may be a constant voltage having a predetermined voltage level.

The power supply 225 may provide the constant voltage VDC having the predetermined voltage level through the third power voltage providing line when the maintain capacitor is coupled to the third power voltage providing line.

As described above, the organic light emitting display device 200 may include the pixels PX1 arranged in the first column that each include the first scan control transistor and the second scan control transistor and block the scan signal GW having the turn-off level from being provided to the pixels PX through the scan lines by turning off the first scan control transistor and the second scan control transistor in the emission period P4. Thus, the degradation of the transistors that occurs due to the electric field generated on the substrate may be prevented. Therefore, the display quality may improve.

Figure 10:
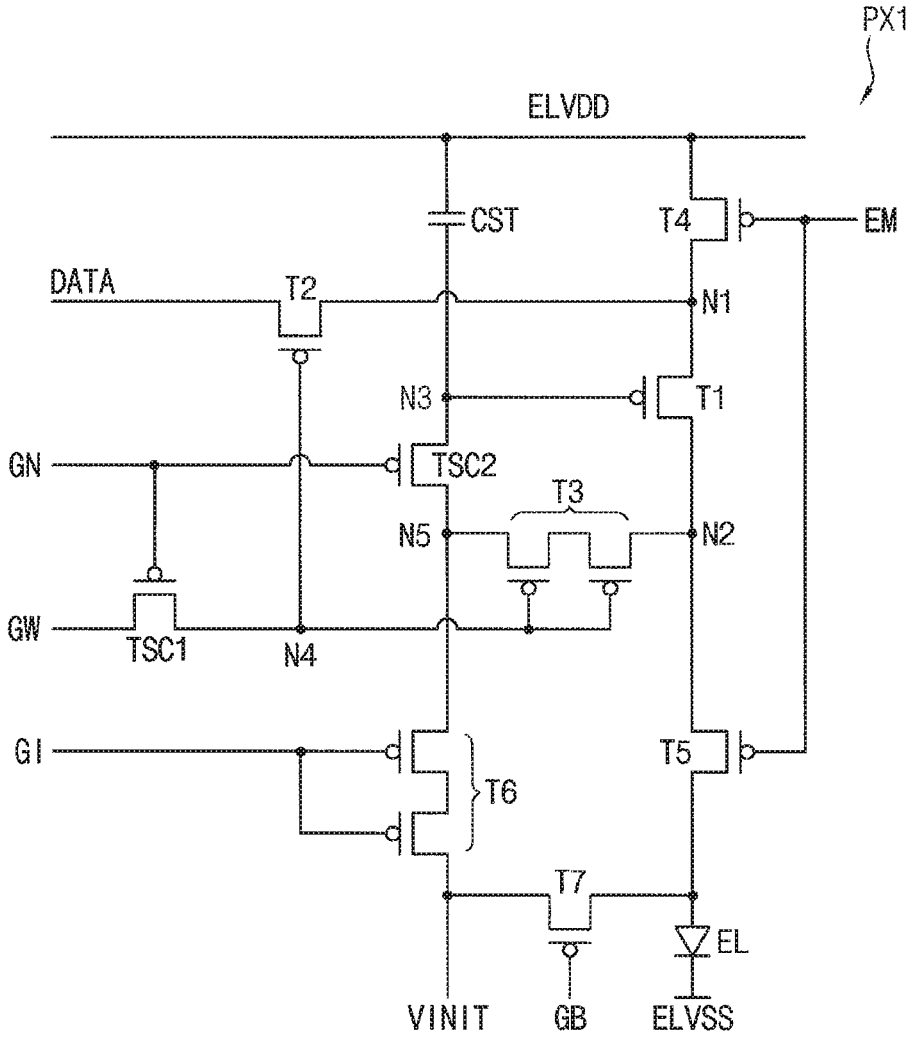
FIG. 10 is a circuit diagram illustrating a pixel included in the organic light emitting display device of FIG. 8 according to an exemplary embodiment of the inventive concept.
Figure 11:
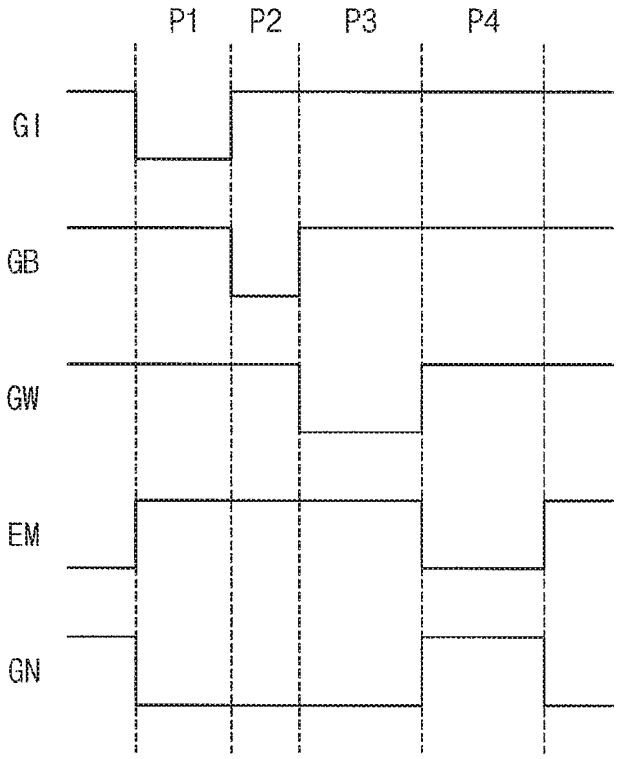
FIG. 11 is a timing diagram illustrating a driving timing of the pixel of FIG. 10 according to an exemplary embodiment of the inventive concept.
Figure 12:
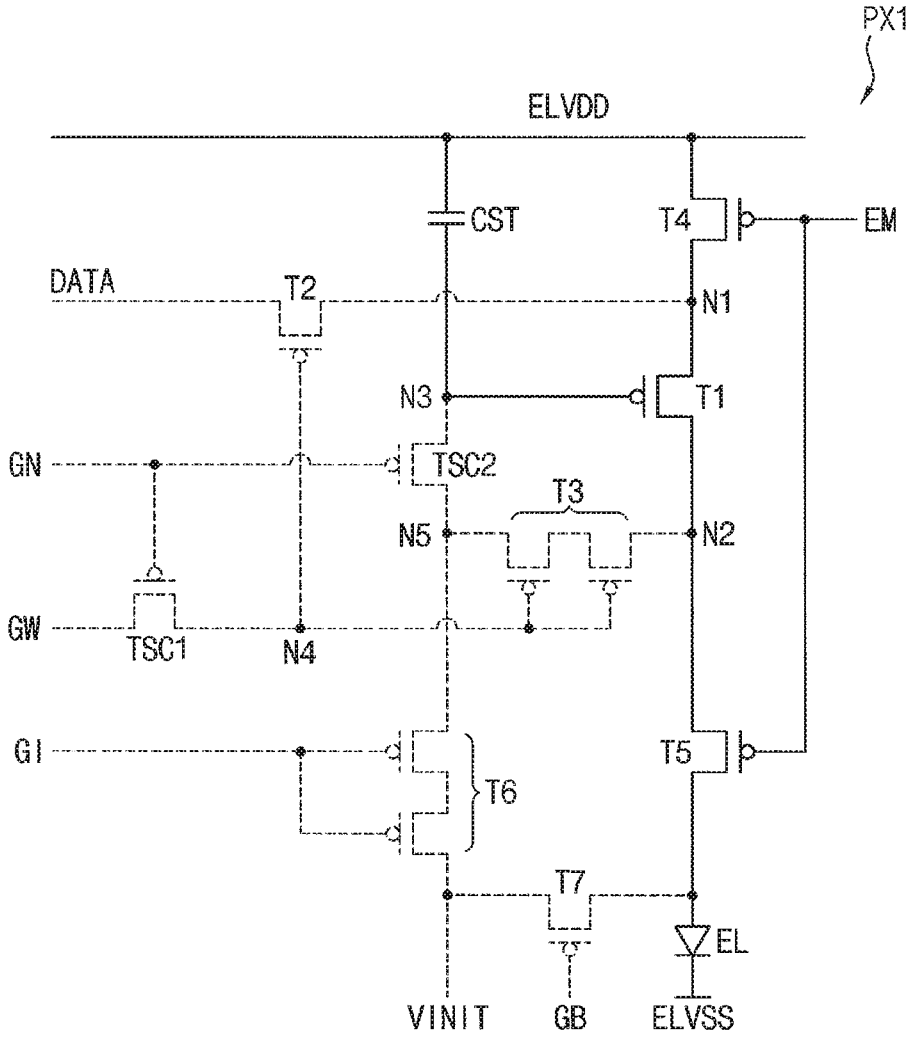
FIG. 12 is a circuit diagram illustrating for describing an operation of the pixel in an emission period of the pixel of FIG. 10 according to an exemplary embodiment of the inventive concept.

FIG. 10 is a circuit diagram illustrating a pixel included in the organic light emitting display device of FIG. 8 according to an exemplary embodiment of the inventive concept. FIG. 11 is a timing diagram illustrating a driving timing of the pixel of FIG. 10 according to an exemplary embodiment of the inventive concept. FIG. 12 is a circuit diagram illustrating for describing an operation of the pixel in an emission period of the pixel of FIG. 10 according to an exemplary embodiment of the inventive concept.

Referring to FIG. 10, the pixels PX1 arranged in the first column of the pixels PX in the organic light emitting display device 200 may include the first transistor T1, the second transistor T2, the storage capacitor CST, the third transistor T3, the fourth transistor T4, the fifth transistor T5, the sixth transistor T6, the seventh transistor T7, the first scan control transistor TSC1, the second scan control transistor TSC2, and the organic light emitting diode EL. The pixel PX1 of FIG. 10 may have substantially the same structure as the pixel PX of FIG. 3 except that the pixel PX1 of FIG. 10 includes the first and the second scan control transistors TSC1 and TSC2, and does not include the maintain capacitor CM.

The first scan control transistor TSC1 may be coupled between the scan line and a gate electrode of the third transistor T3. The first scan control transistor TSC1 may include a first electrode, a second electrode, and a gate electrode. The first electrode may be a source electrode and the second electrode may be a drain electrode. The first electrode of the first scan control transistor TSC1 may correspond to a fourth node N4, the second electrode of the first scan control transistor TSC1 may be coupled to the scan line, and the gate electrode of the first scan control transistor TSC1 may be coupled to the scan control line. The first scan control transistor TSC1 may turn on in response to the scan control signal GN having the turn-on level.

The second scan control transistor TSC2 may be coupled between the storage capacitor CST and a first electrode of the third transistor T3. The second scan control transistor TSC2 may include a first electrode, a second electrode, and a gate electrode. Here, the first electrode may be a source electrode and the second electrode may be a drain electrode. The first electrode of the second scan control transistor TSC2 may correspond to the third node N3, the second electrode of the second scan control transistor TSC2 may correspond to a fifth node N5, and the gate electrode of the second scan control transistor TSC2 may be coupled to the scan control line. The second scan control transistor may turn on in response to the scan control signal GN having the turn-on level.

Referring to FIG. 11, one frame cycle may include the first initialization period P1, the second initialization period P2, the writing period P3, and the emission period P4. The scan control signal GN having the turn-on level may be provided to the pixel PX1 during the first initialization period P1, the second initialization period P2, and the writing period P3, and the scan control signal GN having the turn-off level may be provided to the pixel PX1 in the emission period P4. The first scan control transistor TSC1 may turn on in response to the scan control signal GN having the turn-on level, and provide the scan signal GW to the second transistor T2 and the third transistor T3 during the first initialization period P1, the second initialization period P2, and the writing period P3. The second scan control transistor TSC2 may turn on in response to the scan control signal GN having the turn-on level and couple the first electrode of the third transistor T3 and the gate electrode of the first transistor T1 during the first initialization period P1, the second initialization period P2, and the writing period P3.

In the first initialization period P1, the first scan control transistor TSC1 and the second scan control transistor TSC2 may turn on in response to the scan control signal GN having the turn-on level, the initialization voltage VINIT may be provided to the third node N3 (e.g., the gate electrode of the first transistor T1), and the gate electrode of the first transistor T1 may be initialized as the voltage level of the initialization voltage VINIT. In the second initialization period P2, the first scan control transistor TSC1 and the second scan control transistor TSC2 may turn on in response to the scan control signal GN having the turn-on level, the initialization voltage VINIT may be provided to the anode electrode of the organic light emitting diode, and the anode electrode of the organic light emitting diode may be initialized as the voltage level of the initialization voltage VINIT. In the writing period P3, the first scan control transistor TSC1 and the second scan control transistor TSC2 may turn on in response to the scan control signal GN having the turn-on level, and the voltage corresponding to a sum of the data voltage DATA and a threshold voltage of the first transistor T1 may be stored in the storage capacitor CST.

Referring to FIG. 12, the first scan control transistor TSC1 and the second scan control transistor TSC2 may turn off in the emission period P4. The first scan control transistor TSC1 may turn off and may disconnect the scan line and the second transistor T3. Accordingly, an electrical field that occurs due the voltage difference of the scan signal GW having the turn-off level and the emission control signal EM having the turn-on level may not occur on the substrate. Thus, the degradation of the transistors formed on the substrate may be prevented. The second scan control transistor TSC2 may turn off and may disconnect the storage capacitor CST (e.g., the third node N3) and the first electrode of the third transistor T3 (e.g., the fifth node N5). Accordingly, a leakage current flowing through the third transistor T3 may not flow so that the gate voltage applied to the gate electrode of the first transistor T1 may not be changed.

As described above, the organic light emitting display device 200 may include the first scan control transistor TSC1 and the second scan control transistor TSC2 in the pixels PX1 arranged in the first column of the pixels PX so that the scan signal having the turn-off level provided through the scan line may not be provided and the gate voltage applied to the gate electrode of the first transistor may be maintained. Thus, the display panel may have uniform luminance.

The inventive concept may be applied to a display device and an electronic device having the display device. For example, the inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

As described above, according to exemplary embodiments of the inventive concept, the pixels of the organic light emitting display device may include the maintain capacitor coupled to the gate electrode of the first transistor (e.g., the driving transistor) that maintains the gate voltage applied to the gate electrode of the first transistor during the emission period, so that a decrease of luminance that occurs due to a degradation of the transistors may be prevented. Further, the pixel arranged in the first column of the pixels may include the first scan control transistor and the second scan control transistor that turn off during the emission period, so that the scan signal having the turn-off level may not be provided to the gate electrode of the first transistor. Thus, the gate voltage applied to the gate electrode of the first transistor may be maintained. Therefore, display quality may improve.

While the inventive concept has been particularly shown and described with reference to exemplary embodiments thereof, it will be understood by one of ordinary skill in the art that various changes in form and details may be made thereto without departing from the spirit and scope of the inventive concept as set forth by the following claims.

What is claimed is:

1. An organic light emitting display device comprising:

a display panel including a plurality of pixels, a plurality of scan lines, a plurality of data lines, a first power voltage providing line, a second power voltage providing line, and a plurality of emission control lines; and a panel driver configured to provide a scan signal, a data voltage, a first power voltage, a second power voltage, and an emission control signal to drive the plurality of pixels, and wherein each of the plurality of pixels includes:

a first transistor including a first electrode coupled to a first node, a second electrode coupled to a second node, and a gate electrode coupled to a third node;

a second transistor including a gate electrode configured to receive the scan signal, a first electrode configured to receive the data voltage, and a second electrode coupled to the first node;

a storage capacitor including a first electrode configured to receive the first power voltage and a second electrode coupled to the third node;

a third transistor including a gate electrode configured to receive the scan signal, a first electrode coupled to the third node, and a second electrode coupled to the second node;

a maintain capacitor coupled to the third node, wherein the maintain capacitor is configured to maintain a gate voltage of the first transistor during an emission period of a corresponding pixel;

a fourth transistor including a gate electrode configured to receive the emission control signal, a first electrode coupled to the first power voltage providing line, and a second electrode coupled to the first node;

a fifth transistor including a gate electrode configured to receive the emission control signal, a first electrode coupled to the second node, and a second electrode coupled to a fourth node; and an organic light emitting diode including a first electrode coupled to the fourth node and a second electrode configured to receive the second power voltage;

wherein the maintain capacitor includes a first electrode configured to receive the data voltage and a second electrode coupled to the third node;

wherein each of the plurality of pixels further includes a maintain transistor including a gate electrode configured to receive the emission control signal, a first electrode coupled to the second electrode of the maintain capacitor, and a second electrode coupled to the third node; and wherein the second electrode of the maintain transistor is directly coupled to the first electrode of the third transistor.

2. The organic light emitting display device of claim 1, wherein the maintain transistor turns on in response to the emission control signal during the emission period of the corresponding pixel.

3. The organic light emitting display device of claim 1, wherein the display panel further includes an initialization control line, an initialization voltage providing line, and a bypass line, and wherein the panel driver provides an initialization control signal and a bypass signal to drive the plurality of pixels.

4. The organic light emitting display device of claim 3, wherein each of the plurality of pixels further includes:

a sixth transistor including a gate electrode configured to receive the initialization control signal, a first electrode coupled to the third node, and a second electrode coupled to a fifth node; and a seventh transistor including a gate electrode configured to receive the bypass signal, a first electrode coupled to the fifth node, and a second electrode coupled to the fourth node.

5. The organic light emitting display device of claim 1, wherein one frame cycle includes a first initialization period that initializes the gate electrode of the first transistor, a second initialization period that initializes the first electrode of the organic light emitting diode, a writing period in which the data voltage is stored in the storage capacitor, and the emission period in which the organic light emitting diode emits light.

* * * * *